United States Patent [19]

Eguchi et al.

[11] Patent Number: 4,465,005

[45] Date of Patent: Aug. 14, 1984

[54] APPARATUS FOR DYEING SEWING MACHINE UPPER THREADS

[75] Inventors: Yasukata Eguchi; Susumu Hanyu, both of Tokyo; Chuji Nagasaka, Otsuki, all of Japan

[73] Assignee: Janome Sewing Machine Industry Co., Ltd., Japan

[21] Appl. No.: 452,240

[22] Filed: Dec. 22, 1982

[30] Foreign Application Priority Data

Dec. 22, 1981 [JP] Japan ..... 56-206220

[51] Int. Cl.[3] ..... D05B 67/00

[52] U.S. Cl. ..... 112/270; 112/271; 112/136; 112/275

[58] Field of Search ..... 112/270, 131, 79 A, 112/79 R, 217, 271, 274, 275, 136, 152

[56] References Cited

U.S. PATENT DOCUMENTS

| | | | |
|---|---|---|---|
| 2,675,755 | 4/1954 | Hall | 112/131 X |
| 2,910,026 | 10/1959 | Ajouelo | 112/270 |
| 3,291,097 | 12/1966 | Atkins et al. | 112/270 X |
| 3,502,044 | 3/1970 | Brown et al. | 112/79 R |
| 3,623,440 | 11/1971 | Spedding et al. | 112/79 A |
| 3,948,194 | 4/1976 | Gunold | 112/131 |
| 4,015,550 | 4/1977 | Bartenfeld et al. | 112/79 A |

*Primary Examiner*—H. Hampton Hunter
*Attorney, Agent, or Firm*—William A. Drucker

[57] ABSTRACT

A thread is passed through a dyeing apparatus before the thread is supplied to a sewing machine as an upper thread. The dyeing apparatus has a cylinder containing a plurality of coloring members, each coloring member containing a coloring liquid of a different color. The cylinder is rotated by a manually operated dial to select one of the coloring members in accordance with a stitch to be sewn with a sewing machine. A coloring section of the selected coloring member is exposed to the outside of the cylinder for establishing contact between the thread and the coloring section. A heat-set roller is adapted to come into contact with the thread for heat-setting the coloring liquid applied thereto. The contact between the thread and the coloring member and the heat-set roller is actuated in response to operation of the sewing machine.

7 Claims, 10 Drawing Figures

APPARATUS FOR DYEING SEWING MACHINE UPPER THREADS

BACKGROUND OF THE INVENTION

The invention relates to an apparatus for dyeing a sewing machine upper thread.

So far, it has been necessary to prepare so many threads of different colors as required to be used for stitching operation, especially for making pattern stitches and embroidery stitches with a sewing machine, and to selectively use these threads of different colors in dependence upon the kind of stitches. If a sewing machine operators desires to enjoy a complicated embroidery stitches requiring many different colors according to such a conventional manner, the operator is obliged to interrupt the stitching operation so as to change the sewing machine thread each time a different colored thread is required. Such a thread changing operation comprises the steps of stopping the sewing machine, raising a material presser foot of the sewing machine, cutting off an upper thread previously used, removing the upper thread and then providing the sewing machine with a fresh upper thread of a different color which is to be passed through a number of thread guides, a tensioning device, a thread take-up lever and a needle hole, which is considerably troublesome and time-consuming.

SUMMARY OF THE INVENTION

It is therefore an object of the invention to provide an apparatus for dyeing a sewing machine upper thread which is to be provided for or connected to a sewing machine so as to selectively dye the upper thread with a given color while the upper thread remains to be located on the sewing machine.

Another object of the invention is to provide an automatic control system for smoothly operating the apparatus for dyeing the upper thread in combination with the operation of the sewing machine, with security and saving of energy.

According to an aspect of the invention there is provided an apparatus used in combination with a sewing machine for dyeing a sewing machine upper thread which comprises a housing; a container rotatably mounted on the housing and containing a plurality of coloring members, each coloring member containing a different color liquid; means for selecting one of the coloring members, said selecting means including an operating dial and actuating member, said operating dial being rotatable and axially movable to select one of the coloring members, and said actuating member being moved in association with the axial movement of the operating dial to move the selected one of the coloring members from an ineffective position to an effective position in which the coloring member thus selected is adapted to apply the color liquid to a thread guided into the apparatus; and means for heat-setting the color liquid applied to the thread, said thread being adapted to be guided out of the apparatus to a needle of the sewing machine.

BRIEF DESCRIPTION OF DRAWINGS

Further objects and advantages of the invention can be more fully understood from the following description when read in conjunction with the accompanying drawings in which.

PREFERRED EMBODIMENTS OF THE INVENTION

Figure 4:
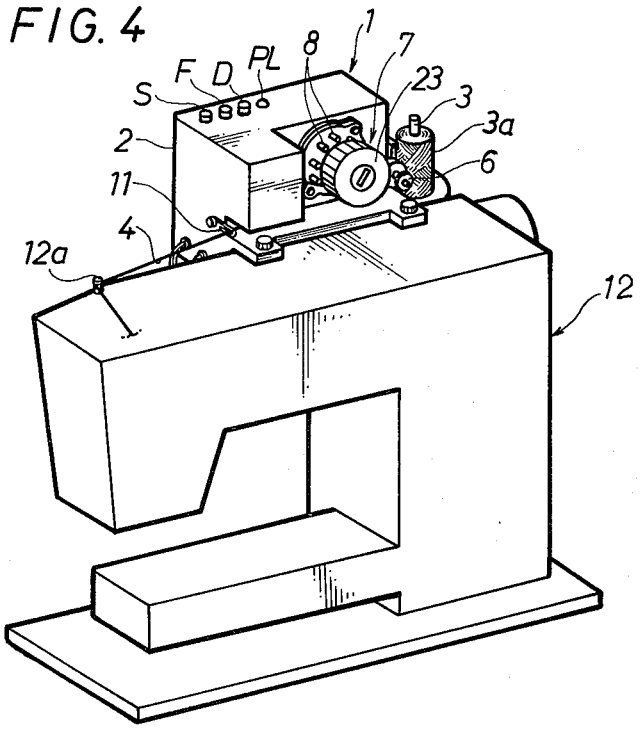
FIG. 4 is a perspective view showing the apparatus of the first embodiment of the invention as used in combination with a sewing machine, by way of example.

In the first embodiment of the invention shown in FIGS. 1–4, on a housing 2 of a dyeing apparatus 1 is mounted a vertically extending rod 3 adapted to carry thereon an upper thread spool 3*a* (FIG. 4). A thread 4 of a white color supplied from the spool 3*a* is passed through a thread guide 5 and advanced to a tensioning device 6 which applies a slight tension to the thread. The thread 4 is then subjected to contact with a selected one of coloring members 8 arranged in a color selecting mechanism 7 so that a dyeing liquid of a selected color is applied to the running thread 4. After passing through a guide opening 9*a* of a thread guide member 9, the thread 4 is subjected to contact with a heat-set roller 10 for heat-setting the dyeing liquid coated on the thread. The thread which has been thus colored with a selected color is guided to the outside of the apparatus 1 through another thread guide 11, and supplied continuously to a sewing machine 12 as an upper thread of the selected color.

When it is required to change the color of the upper thread during the stitching operation, the sewing machine 12 is stopped from driving and the color selecting mechanism 7 is suitably operated. In this case, however, there will remain a portion of the thread which has already been subjected to contact with the previously used coloring member 8. The said portion of the thread is easily removed in a manner as described later.

Figure 1:
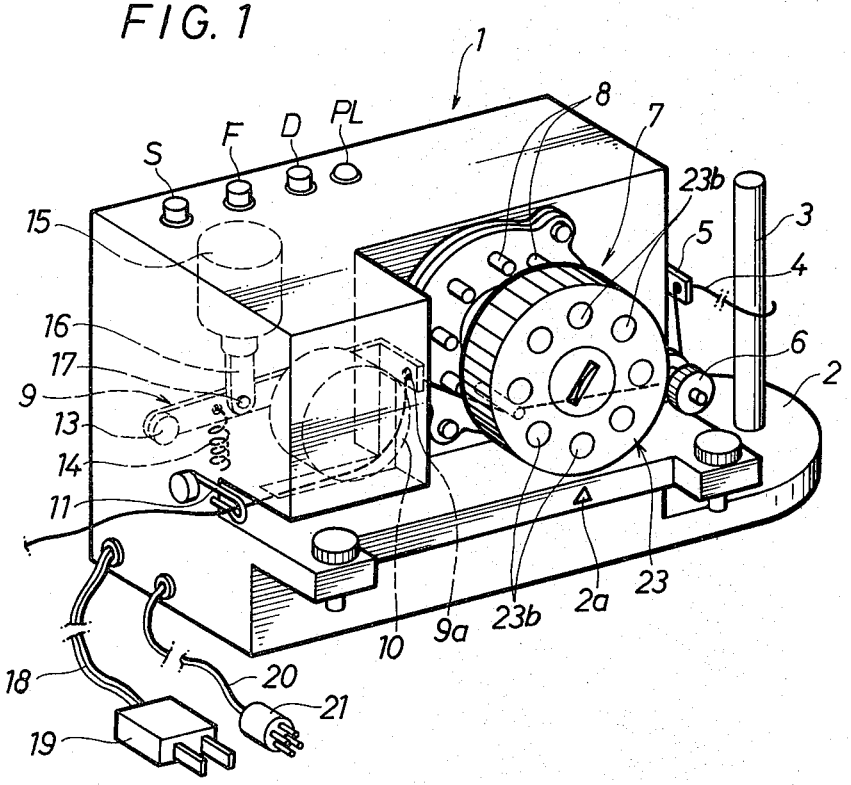
FIG. 1 is a perspective view showing a dyeing apparatus of a first embodiment of the invention.
Figure 2:
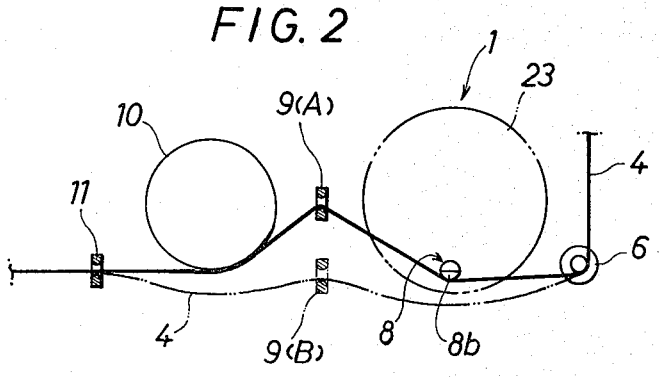
FIG. 2 is a diagrammatic view showing the courses of the upper thread travelling through the apparatus shown in FIG. 1.
Figure 3:
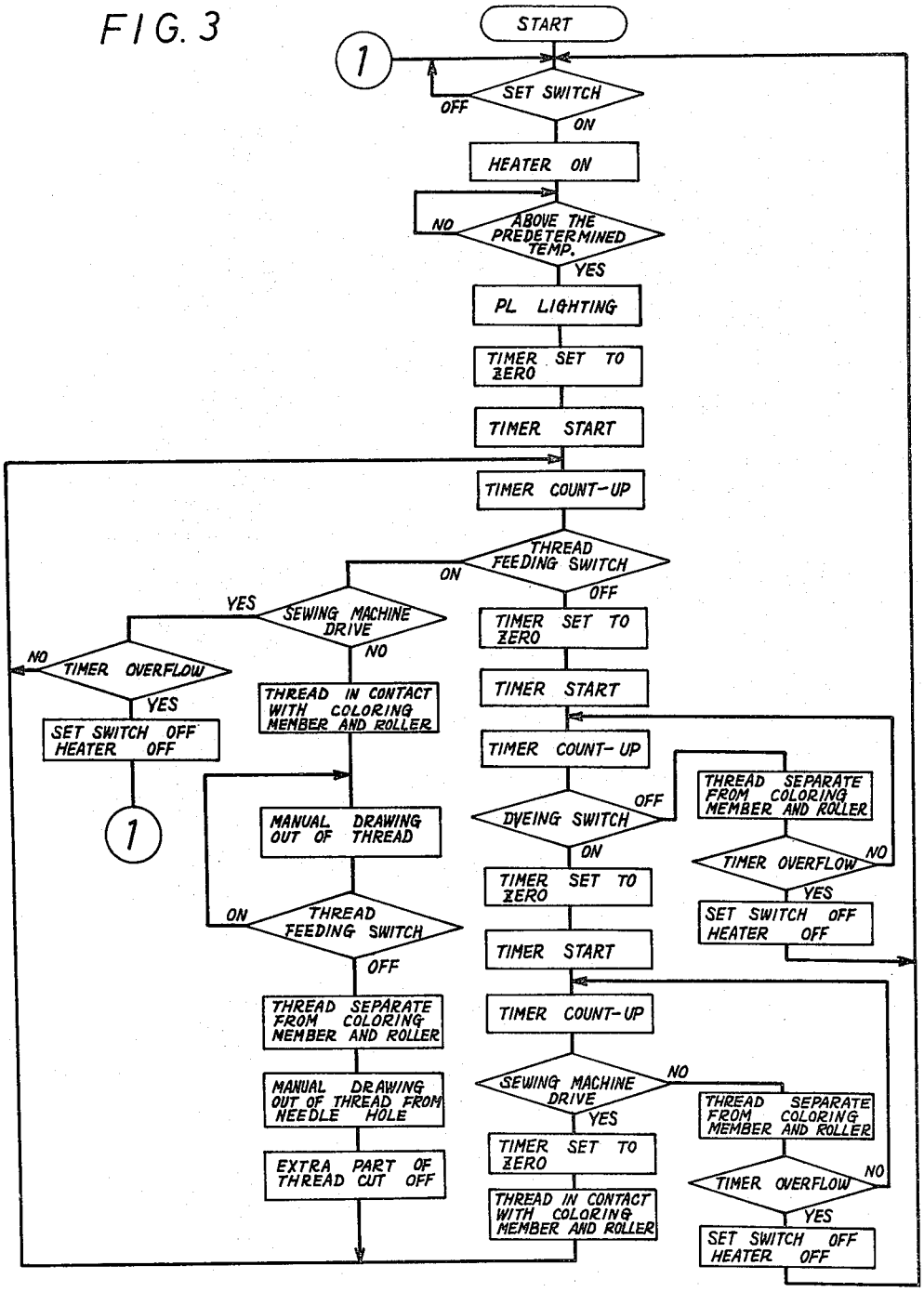
FIG. 3 is a flow chart showing operation of the apparatus of the first embodiment of the invention.

The thread guide member 9 is at one end thereof pivotably connected to the housing 2 by means of a screw 13 and is normally biased to rotate in the clockwise direction (as viewed in FIG. 1) by a spring 14. To a middle portion of the guide member 9 is pivotably connected a plunger 16 of a solenoid 15 by means of a pin 17. The solenoid 15 is controlled by a control circuit (not shown) provided in the dyeing apparatus 1, thereby selectively operating the thread guide member 9 between its operative position (A) shown by a solid line and inoperative position (B) shown by a chain line, as shown in FIG. 2.

A heater (not shown) is provided within the heat-set roller 10. The dyeing apparatus 1 is electrically connectable to the power supply by a cord 18 and a plug receptacle 19. The dyeing apparatus 1 is connected to the sewing machine 12 through a signal transmitting cord 20 and a connecting plug 21 so that a signal of whether the sewing machine 12 is driving or not is transmitted to the control circuit of the apparatus 1.

When a set button S is pushed on condition that the apparatus 1 is connected to the electric power supply, a set switch (not shown) is turned on and the heater of the heat-set roller 10 is also switched on. A pilot lamp PL is switched on when a temperature of the roller is elevated to a predetermined value. A thread feeding button F is operated to turn on a thread feeding switch (not shown), so that a predetermined amount of the thread 4 is drawn out at the time of beginning the stitching operation and changing a color of the thread, as in a manner described later, while the upper thread is being located on the sewing machine 12. A dyeing button D is operated to turn on a dyeing switch (not shown), and then the sewing machine may be driven for stitching operation while continuously coloring the upper thread by the apparatus 1.

Figure 5:
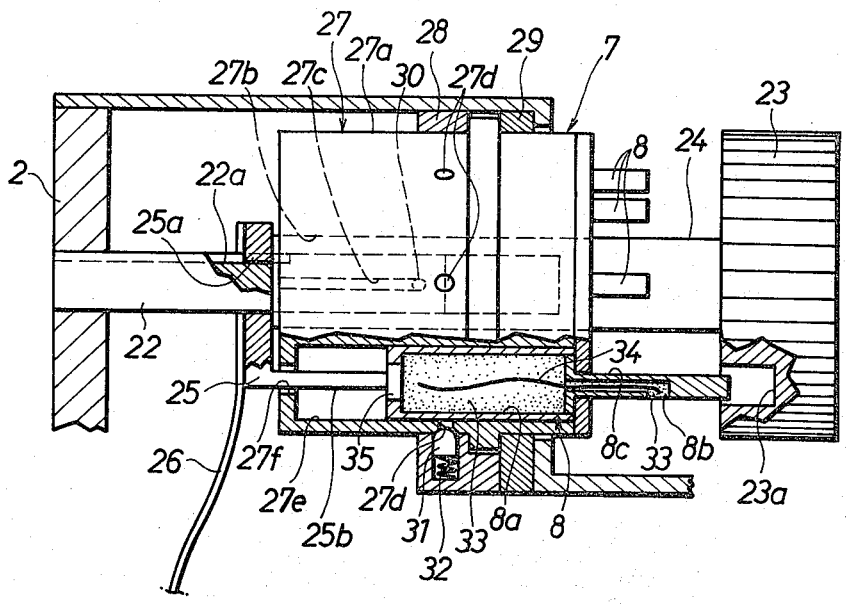
FIGS. 5 and 6 are partial sectional views showing a color selecting mechanism of the dyeing apparatus, which can be commonly used for the first embodiment and second embodiment of the invention.
Figure 6:
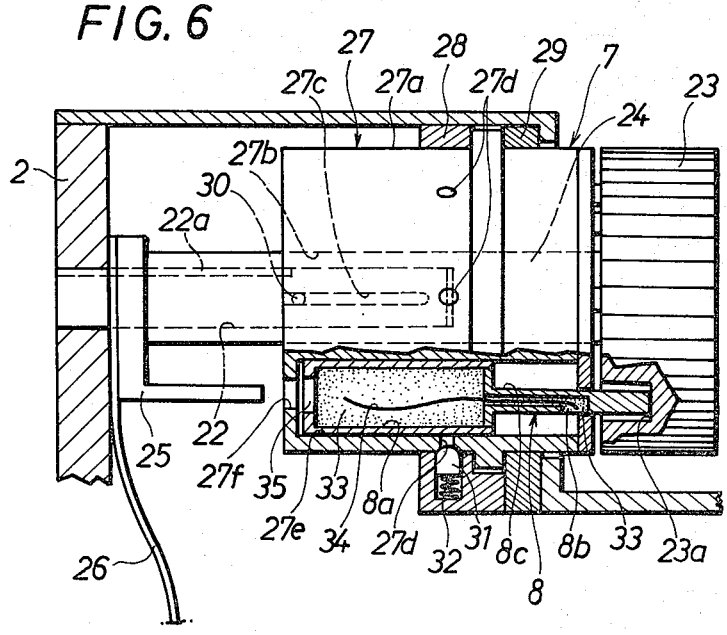

The color selecting mechanism 7 is shown in FIGS. 5 and 6. More particularly, a laterally extending shaft 24 is supported on a stationary shaft 22 fixed to the housing 2, and is axially slideable and rotatable relative to the stationary shaft 22. The shaft 24 is at one end thereof provided integrally with a color selecting dial 23. An actuating member 25 provided with an extending arm **25*b* is slideable but not rotatable with respect to the stationary shaft 22, which is established by engagement between a projection 25*a* of the member 25 and axial groove 22*a* of the shaft 22. The actuating member 25 is normally biased in the rightward direction (as viewed in FIGS. 5 and 6) by means of a spring 26 to thereby normally bias the shaft 24 in the rightward direction as shown in FIG. 5**.

A cylinder 27 is supported on the dial shaft 24 in the housing 2 and is prevented from axial movement by a pair of peripheral supporting members 28 and 29. The cylinder 27 has an axial groove **27*c* formed on the inner peripheral wall 27*b* thereof and being in engagement with a pin 30 outwardly projecting from the shaft 24. The cylinder 27 is therefore prevented from rotation relative to the shaft 24. The cylinder 27 is, however, rotated together with the dial shaft 24 when the dial 23 is operated to rotate while being pressed against the force of the spring 26 as shown in FIG. 6. The dial 23 is provided with a plurality of circularly arranged holes 23*a* adapted to receive the coloring members 8 respectively at the time of pressing the dial (FIG. 6**).

A positioning pin 31 is provided in the supporting member 28 and is pressed by a spring 32 against one of positioning recesses **27*d* circularly arranged on the outer surface of the cylinder 27**.

The cylinder 27 has a plurality of hollow sections **27*e* provided around the center axis thereof for respectively containing the coloring members 8 of different colors. The coloring member 8 has an enlarged hollow base 8*a* in which a felt 33 impregnated with a coloring liquid is contained, and a coloring section 8*b* which has a notched opening 8*d* formed at the intermediate part thereof and is connected to the base 8*a* by way of a conduit 8*c*. The coloring liquid is fed from the base 8*a* through the conduit 8*c* to the notched opening 8*d* by way of a wick 34 positioned in the conduit 8*c*. A screw 35 is screwed into the rear end of the base 8*a* to close the same and thus the coloring liquid can be replenished therethrough. The coloring member 8 received in the hollow section 27*e* is axially slideable, but can not be rotated. When the operation of the dial 23 is released after one of the coloring members 8 has been selected, the selected coloring member 8 is moved by the pushing member 25 urged by the spring 26 so that the coloring section 8*b* thereof is exposed to the outside of the cylinder 27, as shown in FIG. 5**.

The dial 23 has a plurality of color indicators **23*b* corresponding respectively to the holes 23*a* for receiving the coloring sections 8*b*. The color indicators 23*b* can be seen from the outside of the apparatus 1. The color changing operation is carried out by operating the dial 23 and setting the selected one of the color indicators 23*a* to a mark 2*a* shown on the housing 2**.

The first embodiment of the invention as described above is operated as follows.

The apparatus 1 may be mounted on or placed near the sewing machine 12. A white colored thread 4 unwound from the spool **3*a* and passed through the guide member 5, tensioning device 6 and guide opening 9*a* is passed around the heat-set roller 10, and then guided to the outside of the apparatus through the thread guide 11. The thread is then supplied as an upper thread to the sewing machine through a thread guide 12*a*** thereof and finally passed through a needle hole as in a conventional manner.

Thereafter, the set button S is operated to turn on the set switch, to thereby turn on the heater of the heat-set roller 10. Then the pilot lamp PL is lighted when the temperature of the heat-set roller 10 reaches a predetermined value, and a timer is set to zero to start counting-up.

The dial 23 is then pushed against the force of the spring 26 and is then rotated as shown in FIG. 6, until a desired one of the color indicators **23*b* comes to the mark 2*a*. If the dial 23 is released after a color has been selected in such a manner, the dial 23 is returned to the inoperative position as shown in FIG. 5 by the action of the spring 26, and simultaneously the pushing member 25 is moved in the rightward direction so that the arm 25*b* thereof will push the selected coloring member 8 through the opening 27*f* of the cylinder 27 to expose the coloring section 8*b* of the selected coloring member 8 to the outside of the cylinder 27**.

Then, instead of driving the sewing machine 12, the thread feeding button F is pushed to turn on the thread feeding switch so as to energize the solenoid 15 which will thus cause the thread guide member 9 to turn in the counterclockwise direction around the pivot 13 (as viewed in FIG. 1) to the position (A) shown in FIG. 2 in which the thread 4 is brought into contact with the notched opening **8*d* of the coloring section 8*b* and the heat-set roller 10. Thus, the thread which has been dyied with the selected color is manually drawn out of the apparatus 1**.

After a sufficient amount of the thread 4 is drawn out in such manner, the thread feeding button F is pushed again to turn off the thread feeding switch, which deenergizes the solenoid 15 so that the thread guide member 9 is turned in the clockwise direction by the spring 14 to the position (B) shown by a dotted line in FIG. 2 in which the thread 4 is spaced from the notched opening **8*d* of the coloring member 8 and the roller 10**.

At this time, some amount of the forward portion of the thread remains to be white colored. Then, the tensioning device of the sewing machine is made ineffective and the uncolored portion of the thread is manually pulled out of the needle hole and cut away. Thus, the thread 4 which has been colored with the selected color is located on the sewing machine 12 and is passed through the needle hole, without slackening between the apparatus 1 and the sewing machine 12, and is therefore ready for stitching operation.

For starting the pattern stitching operation, a material to be sewn is placed on a needle plate. The dyeing button D is pushed to turn on the dyeing switch, and thus the timer is set to zero. The timer then starts counting-up. If the operation of the sewing machine is started within a predetermined count of the timer, the timer is again set to zero. As a result, the stitching operation starts and continues while continuously dyeing the upper thread with the selected color.

When it is required to change the color of the upper thread during the stitching operation, the sewing machine 12 is stopped from driving so as to separate the thread 4 from the notched opening 8*d* of the coloring member 8 and the roller 10. The dial 23 is operated in the aforementioned manner to select a new color to be applied to the upper thread 4, instead of the previously used color. Then, the thread feeding button F is pushed to turn on the thread feeding switch, thereby performing the sequential steps of the thread feeding operation as described above in detail. The upper thread 4 of a portion which has been colored with the new color is pulled out until this portion of the thread passes through the needle hole, and the extra part is cut away. Thus, the remaining portion of the thread is ready for further stitching operation requiring the new color. When the dyeing button D is then pushed to turn on the dyeing switch and the sewing machine is driven, the stitching operation is again initiated and continues while continuously coloring the upper thread 4 with the selected new color.

The first embodiment of the invention is also provided with automatic control system for security and saving of energy. More particularly, the operator sometimes has to leave the sewing machine when the pilot lamp PL is lightening showing that the temperature of the heat-set roller 10 has been raised to a predetermined value and when the thread feeding button F and the dyeing button D are not yet operated. In this condition, the upper thread 4 is still separated from the coloring member 8 and the heat-set roller 10. If this condition is kept for a predetermined time, the timer overflows and automatically turns off the set switch and the heater.

Moreover, if the thread feeding switch is turned on while driving the sewing machine 12, a series of steps of the thread feeding operation are not performed so far as the sewing machine continues to drive. In this case, the timer overflows to turn off the set switch and the heater.

Furthermore, if the sewing machine is not started to drive while the thread feeding switch is off and the dyeing switch is on, the upper thread is separated from the coloring member 8 and the heater 10 and the timer overflows to automatically turn off the set switch and the heater.

The second embodiment of the invention will be hereinunder described in detail, but the corresponding parts and elements of the second embodiment are accompanied with the numerals identical to those of the first embodiment.

Figure 7:
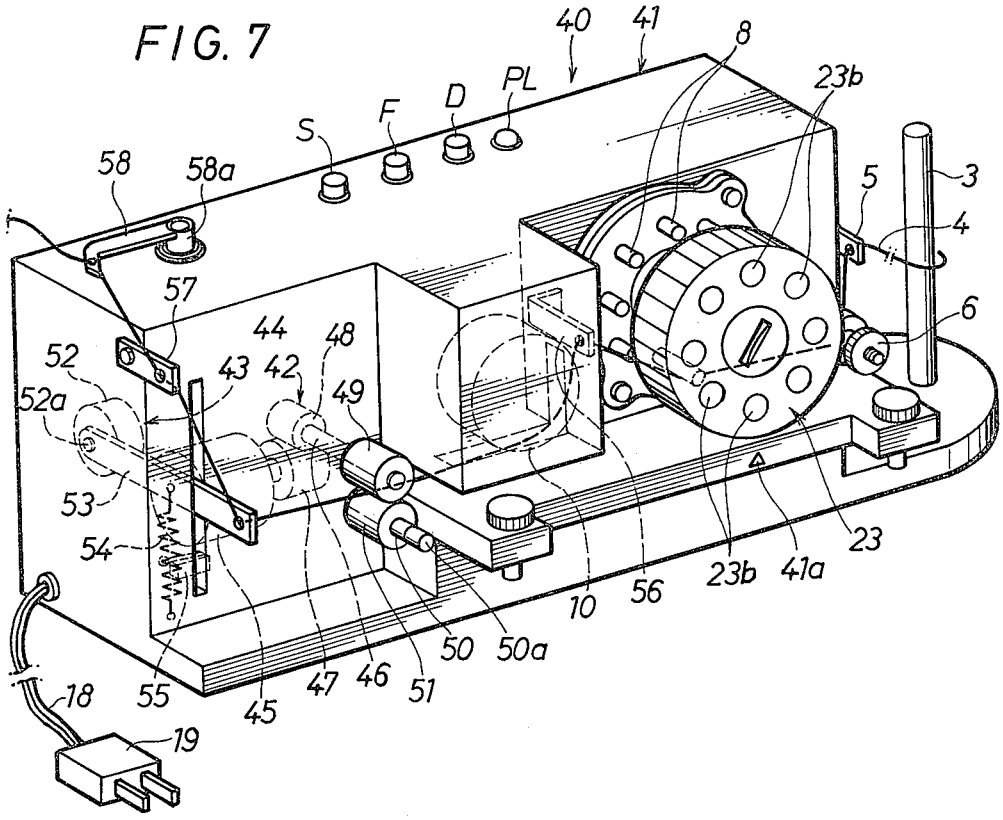
FIG. 7 is a perspective view showing a dyeing apparatus of a second embodiment of the invention.

As shown in FIG. 7, the dyeing apparatus 40 of the second embodiment has a housing 41 and is additionally provided with a thread feeding mechanism 44 consisting of a thread feeding section 42 and a control section 43. The thread feeding section 42 is composed of a motor 45, a first roller 49 rotated about an axis 46 by the motor 45 via gears 47 and 48, and a second roller 51 freely rotatable about an axis 50. The second roller 51 is normally in contact with the first roller 49 but can be separated therefrom by operation of a knob 50*a*.

The control section 43 is composed of a potentiometer 52, a thread guide member 53 turnable about an axis 52*a* of the potentiometer 52, a spring 54 adapted to rotate the thread guide member 53 in the clockwise direction (as viewed in FIG. 7) about the axis 52*a*, and a switch 55 operated to be opened or closed depending upon the rotational movement of the thread guide member 53. Numeral numbers 56, 57 and 58 identify thread guides. The thread guide 58 is supported by a vertically telescopic rod 58*a*.

A thread 4 of a white color unwound from a spool 3*a* is passed through a thread guide 5, advanced to a tensioning device 6 which applies a slight degree of tension thereto, and subjected to contact with a selected one of a plurality of coloring members 8 provided in a color selecting mechanism 7 so that a dyeing liquid of a selected color is applied to the thread, in the same manner as in the first embodiment. The thread 4 is then passed through the guide member 56, and is subjected to contact with the heat-set roller 10 for heat-setting the dyeing liquid coated thereon. The thread which has been thus colored with a selected color is continuously fed while being passed between the two rollers 49 and 51 and through the guide members 53, 57 and 58, and then continuously supplied to the sewing machine 12 as an upper thread.

Although the thread guide member 53 is normally biased in the clockwise direction by the action of the spring 54, the guide member 53 will be changed in position in accordance with the balance of the thread consumption between in the sewing machine and in the apparatus 40. More particularly, the guide member 53 will move upwardly when the amount of the thread consumed in the stitching operation with the sewing machine 12 is greater than that supplied by the rollers 49 and 51, whereas it will move downwardly when the latter is greater than the former. Such a condition of the guide member 53 is detected by the potentiometer 52, which, in turn, controls the revolution of the motor 45 to change the thread consumption in the apparatus 40 in accordance with the thread consumption in the sewing machine 12. Thus, the thread guide member 53 is always held to horizontally extend as shown in FIG. 7, irrespectively of the variable thread consumption of the sewing machine.

Figure 10:
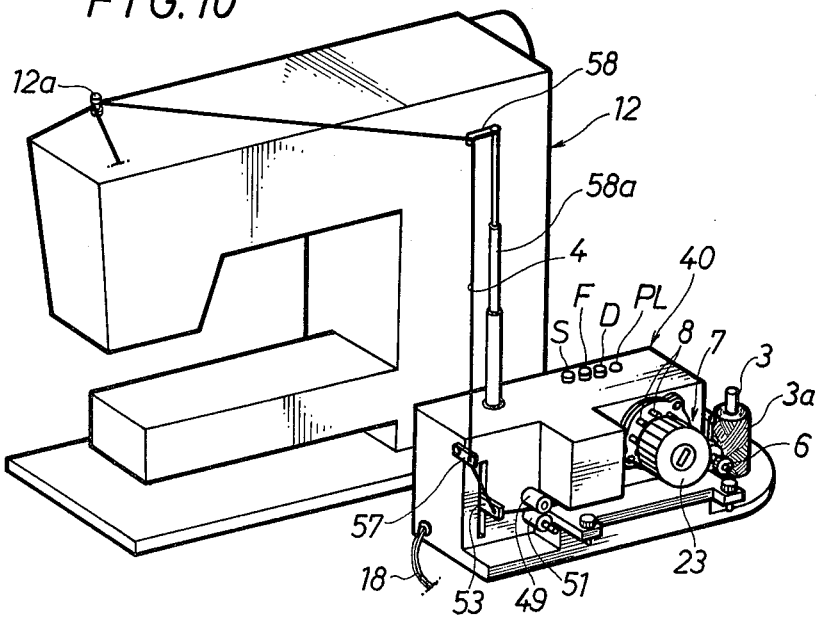
FIG. 10 is a perspective view showing the apparatus of the second embodiment as used in combination with the sewing machine, by way of example.

Before starting the operation of the apparatus 40, a white colored thread 4 is located thereon and passed beneath the roller 10 in a manner substantially the same as in the first embodiment. The knob 50*a* is operated to separate the roller 49 from the roller 51, between which the thread is passed to set. The thread 4 is then passed through the guide members 53, 57 and 58 and then supplied to the sewing machine 12 through a guide 12*a* thereof. The apparatus 40 may be placed on or near the sewing machine 12, and in the latter case the rod 58 is preferably extended upwardly as shown in FIG. 10.

Figure 8:
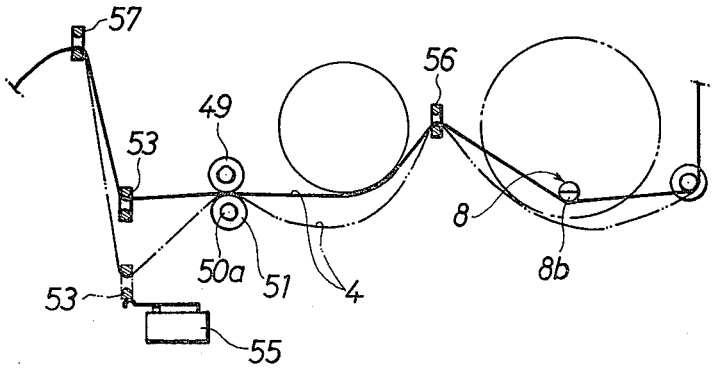
FIG. 8 is a diagrammatic view showing the courses of the thread travelling through the apparatus shown in FIG. 7.

The upper thread 4 thus passing through the apparatus 40 is slackened off so as not to be in contact with the notched opening 8*d* of the coloring member 8 and the roller 10 as shown by a dotted line in FIG. 8, and then the knob 50*a* is operated to thereby press the upper thread 4 between the two rollers 49 and 51.

Thereafter, the set button S is operated to turn on the set switch and thereby make effective the heater of the heat-set roller 10, to light the pilot lamp PL when the temperature of the roller 10 reaches to a predetermined level, to set a timer to zero and to start the timer counting-up, in the same manner as described in connection with the operation of the first embodiment.

The dial 23 is then operated to select a color to be applied to the upper thread 4. This operation has been described in detail with respect to the first embodiment, referring to FIGS. 5 and 6.

After one of the coloring section 8*b* of a selected color is protruded from the cylinder 27 as shown in FIG. 5, the thread feeding button F is pushed to turn on the thread feeding switch.

When the sewing machine 12 is not driving, the thread guide member 53 is normally positioned at the lowermost position by the action of the spring 54 and thus turns on the control switch 55, as shown by a dotted line in FIG. 8. However, when the upper thread 4 is manually drawn out from the apparatus 40 with the thread feeding switch being on, the thread guide member 53 is separated from the switch 55 to turn off the same. As a result, the roller 49 is rotated in the normal direction by the motor 45 and the upper thread 4 is fed by passing between the rollers 49 and 51 while being in contact with the coloring section 8*b* and the roller 10.

After a sufficient amount of the thread 4 has been drawn out from the apparatus 40 while being dyied with the selected color, the thread guide member 53 is turned in the clockwise direction by the action of the spring 54 and turns on the control switch 55. Then, the roller 49 is rotated in the opposite direction to thereby separate the thread 4 from the coloring member 8 and the roller 10, and which turns off the thread feeding switch. The upper thread 4 slackened between the apparatus 40 and the sewing machine 12 is tightened and some amount of the uncolored portion of the thread is cut away. The upper thread is thus ready for stitching operation.

For starting the stitching operation, a material to be sewn is placed on a needle plate. The dyeing button D is pushed to turn on the dyeing switch, and the timer is set to zero. The timer is then started counting-up, and when the sewing machine 12 is started driving within a predetermined count of the timer, the control switch 55 is turned off to rotate the roller 49 in the normal direction and the timer is again set to zero. As a result, stitching operation starts and continues while the upper thread is continuously dyied with the selected color.

During the stitching operation, a consumption rate of the upper thread 4 is detected by the potentiometer 52 so that the upper thread 4 is fed by the rollers 49 and 51 at a rate corresponding to the consumption rate of the sewing machine 12 thus detected.

When it is required to change the color of the upper thread 4 during the stitching operation, the sewing machine is stopped from driving. The thread guide member 53 is moved downwardly to turn on the control switch 55, thereby rotating the roller 49 in the opposite direction until the thread 4 is separated from the coloring member 8 and the roller 10. Then, the dial 23 is operated to select a color to be newly used and the thread feeding button F is pushed to turn on the thread feeding switch, so that the thread 4 will be brought into contact with the new coloring member 8 and the roller 10. The upper thread 4 is therefore dyied with the new color as it is manually drawn out from the apparatus 40.

When a sufficient amount of the colored thread is drawn out from the apparatus 40, the thread guide member 53 is turned in the clockwise direction to turn on the control switch 55, thereby rotating the roller 49 in the opposite direction until the thread 4 is separated from the coloring member 8 and the roller 10, and then the thread feeding switch is turned off. The upper thread 4 slackened between the apparatus 40 and the sewing machine 12 is tightened and some amount of the forward portion of the thread which is dyied with the previously used color is cut off. The color changing operation is now completed and the upper thread 4 is ready for further stitching operation.

After completion of the color changing operation, the dyeing button D is pushed and the sewing machine 12 is started to drive so that the stitching operation is again initiated and continues while continuously dyeing the upper thread 4 with the new color.

Figure 9:
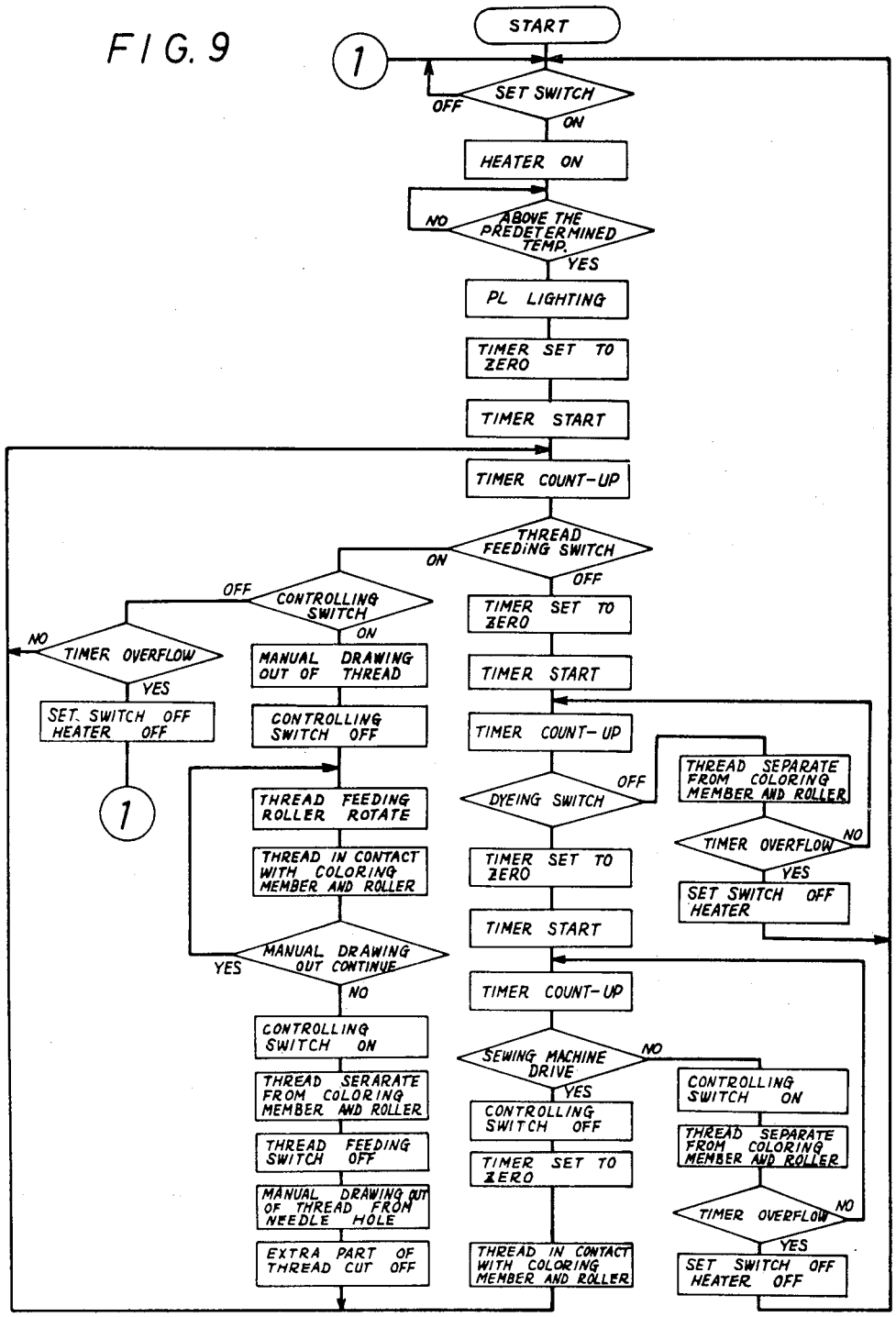
FIG. 9 is a flow chart showing operation of the apparatus of the second embodiment of the invention.

The second embodiment of the invention is provided with automatic control system for security and saving of energy, which is similar to that of the first embodiment and specifically shown in FIG. 9.

Although this invention has been shown and described in terms of preferred embodiments thereof, it should be understood that many changes and modifications will be obvious to one skilled in the art without departing from the true spirit and scope of the invention as defined in the appended claims.

What is claimed is:

1. Apparatus used in combination with a sewing machine for dyeing a sewing machine upper thread, comprising:

a housing;

a container rotatably mounted on said housing and containing a plurality of coloring members, each coloring member containing a different color liquid;

means for selecting one of said coloring members, said selecting means including an operating dial and actuating member, said operating dial being rotatable and axially movable to select one of said coloring members, and said actuating member being moved in association with the axial movement of said operating dial to move the selected one of said coloring members from an ineffective position to an effective position in which the coloring member thus selected is adapted to apply the color liquid to a thread guided into the apparatus; and means for heat-setting the color liquid applied to the thread, said thread being adapted to be guided out of the apparatus to a needle of the sewing machine.

2. Apparatus according to claim 1 which further comprises means for holding the thread in contact with the coloring member and the heat-setting means in response to starting of the sewing machine and for releasing said contact of the thread with the coloring member and the heat-setting means in response to stopping of the sewing machine.

3. Apparatus according to claim 1 or 2 which further comprises means for positioning the selected coloring member at a predetermined position.

4. Apparatus according to claim 1 which further comprises a thread guide member adapted to pass the thread therethrough, said thread guide member being normally in an inoperative position wherein the thread is not in contact with the coloring member and the heat-setting means, and moved to an operative position when the thread continuously passes therethrough, at which operative position the thread is continuously dyied by contact thereof with the selected coloring member and the heat-setting means.

5. Apparatus according to claim 4 which further comprises a motor rotated at the time of driving the sewing machine for continuously supplying thereto the thread of a selected color, in response to operation of the sewing machine.

6. Apparatus according to claim 5 wherein the revolution rate of said motor is controlled to correspond to thread consumption rate in the sewing machine.

7. Apparatus according to claim 5 which further comprises a switch means operated by said thread guide member being in the inoperative position for rotating said motor in the opposite direction until the thread comes out of contact with the coloring member and the heat-setting means.

* * * * *